US011142990B2

(12) United States Patent
Fadhil et al.

(10) Patent No.: US 11,142,990 B2
(45) Date of Patent: Oct. 12, 2021

(54) ANTI-PRESET FOR PACKERS

(71) Applicant: Halliburton Energy Services, Inc., Houston, TX (US)

(72) Inventors: Mohammed Kamal Fadhil, Plano, TX (US); Cynthia Strickland Tuckness, Coppell, TX (US); Jeremy Lynn Stanley, McKinney, TX (US); Bruce Alan Moore, Highland Village, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/839,885

(22) Filed: Apr. 3, 2020

(65) Prior Publication Data

US 2020/0332622 A1 Oct. 22, 2020

Related U.S. Application Data

(60) Provisional application No. 62/835,821, filed on Apr. 18, 2019.

(51) Int. Cl.
*E21B 23/04* (2006.01)
*E21B 23/06* (2006.01)
(Continued)

(52) U.S. Cl.
CPC ..... *E21B 33/1285* (2013.01); *E21B 23/04* (2013.01); *E21B 23/06* (2013.01); *E21B 33/1295* (2013.01)

(58) Field of Classification Search
CPC .. E21B 23/0411; E21B 23/04; E21B 23/0421; E21B 23/06; E21B 33/1295
See application file for complete search history.

(56) References Cited

U.S. PATENT DOCUMENTS 4,216,827 A * 8/1980 Crowe ..... E21B 23/06 166/120
5,103,901 A 4/1992 Greenlee
(Continued)

FOREIGN PATENT DOCUMENTS

GB 2316699 * 4/1998 ..... E21B 33/1295

*Primary Examiner* — Cathleen R Hutchins
(74) *Attorney, Agent, or Firm* — Scott Richardson; Parker Justiss, P.C.

(57) ABSTRACT

Disclosed herein are embodiments of a packer assembly and a well system. In one embodiment, a packer assembly includes an inner mandrel; a packing element at least partially surrounding the inner mandrel; a packing element activation sleeve coupled to the packing element; a hydrostatic setting assembly engageable with the packing element activation sleeve; and a hydraulic setting assembly positioned between the packing element and the hydrostatic setting assembly. The hydrostatic setting assembly includes a hydrostatic piston; a hydrostatic prop piston engageable to push the hydrostatic piston to engage the packing element activation sleeve; and a hydrostatic locking mechanism to maintain the hydrostatic piston in a locked position. The hydraulic setting assembly includes a hydraulic piston; a hydraulic locking mechanism coupled to the hydraulic piston; and a hydraulic prop piston engageable with the hydraulic locking mechanism and operable to move the hydraulic locking mechanism between locked and unlocked position.

20 Claims, 21 Drawing Sheets

(51) Int. Cl.
*E21B 33/1295* (2006.01)
*E21B 33/128* (2006.01)

(56) References Cited

U.S. PATENT DOCUMENTS

| | | | | |
|---|---|---|---|---|
| 5,404,956 | A | 4/1995 | Bohlen et al. | |
| 6,997,252 | B2 | 2/2006 | Porter et al. | |
| 7,836,961 | B2 | 11/2010 | Li et al. | |
| 8,967,280 | B2 | 3/2015 | Doane et al. | |
| 2018/0106127 | A1* | 4/2018 | Du | E21B 33/1285 |

* cited by examiner

ANTI-PRESET FOR PACKERS

CROSS-REFERENCE TO RELATED APPLICATION

This application claims the benefit of U.S. Provisional Application Ser. No. 62/835,821, filed on Apr. 18, 2019, entitled "ANTI-PRESET FOR PACKERS," commonly assigned with this application and incorporated herein by reference in its entirety.

BACKGROUND

Production packers provide reservoir isolation in the casing annulus and provide production tubing anchoring capabilities. Some packers may be set using hydrostatic wellbore pressure and applied surface pressure without plugs, and some packers may also include a hydraulic set contingency with a plug if the hydrostatic unit fails to set.

BRIEF DESCRIPTION

Reference is now made to the following descriptions taken in conjunction with the accompanying drawings, in which.

DETAILED DESCRIPTION

Figure 1:
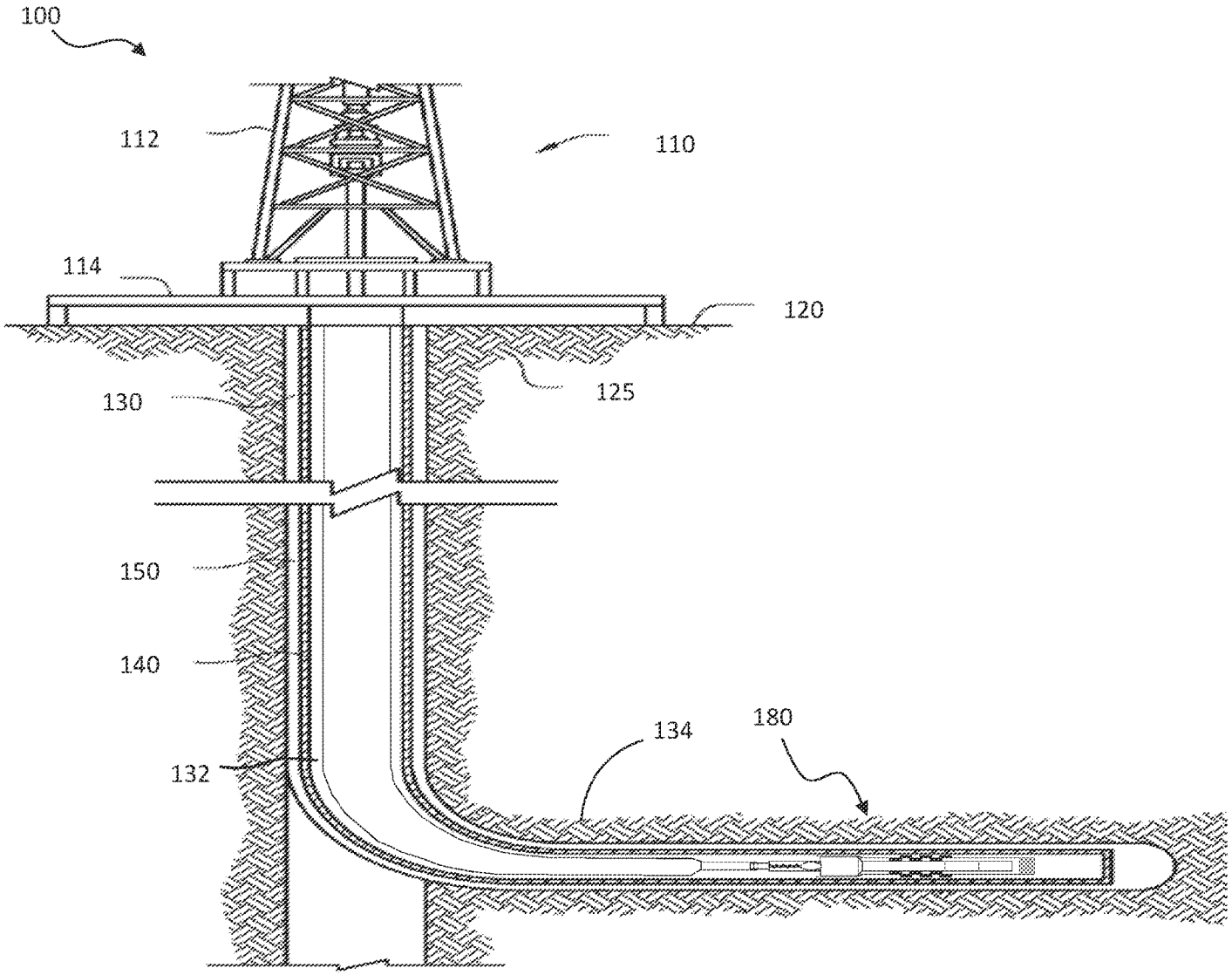
FIG. 1 illustrates a well system including an exemplary operating environment in accordance with the disclosure.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described. Furthermore, unless otherwise specified, use of the terms "up," "upper," "upward," "uphole," "upstream," or other like terms shall be construed as generally toward the surface of the formation; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. Additionally, unless otherwise specified, use of the term "subterranean formation" shall be construed as encompassing both areas below exposed earth and areas below earth covered by water such as ocean or fresh water.

During downhole deployment, there is a risk of debris and external forces to the packer assemblies. In traditional packer assemblies, contact with debris or external forces could cause the packing element to accidentally deploy before the packer assembly reaches a desired position within the wellbore. The present disclosure provides embodiments of packer assemblies having one or more locking mechanisms on one or more packer setting systems. The locking mechanisms prevent premature setting of the packing elements caused by external forces.

Referring to FIG. 1, depicted is a well system 100 including an exemplary operating environment that the apparatuses, systems and methods disclosed herein may be employed. Unless otherwise stated, the horizontal, vertical, or deviated nature of any figure is not to be construed as limiting the wellbore to any particular configuration. As depicted, the well system 100 may suitably comprise a drilling rig 110 positioned on the earth's surface 120, or alternatively moored to a sea floor in a body of water, and extending over and around a wellbore 130 penetrating a subterranean formation 125 for the purpose of recovering hydrocarbons and the like. The wellbore 130 may be drilled into the subterranean formation 125 using any suitable drilling technique. In one embodiment, the drilling rig 110 comprises a derrick 112 with a rig floor 114. The drilling rig 110 may be conventional and may comprise a motor driven winch and/or other associated equipment for extending a work string, a casing string, or both into the wellbore 130.

In one embodiment, the wellbore 130 may extend substantially vertically away from the earth's surface 120 over a vertical wellbore portion 132, or may deviate at any angle from the earth's surface 120 over a deviated wellbore portion 134. In this embodiment, the wellbore 130 may comprise one or more deviated wellbore portions 134. In alternative operating environments, portions or substantially all of the wellbore 130 may be vertical, deviated, horizontal, and/or curved. The wellbore 130, in this embodiment, includes a casing string 140. In the embodiment of FIG. 1, the casing string 140 is secured into position in the subterranean formation 125 in a conventional manner using cement 150.

The well system 100 of the embodiment of FIG. 1 further includes a packer assembly 180 manufactured in accordance with this disclosure. In accordance with the disclosure, the packer assembly 180 includes at least a packing element positioned uphole of a hydraulic setting assembly and a hydrostatic setting assembly positioned further downhole of the hydraulic setting assembly.

Once the packer assembly 180 reaches a desired position within the wellbore, the packing element is set—in some embodiments driven radially outward toward the wellbore casing. If the hydrostatic setting assembly fails to mechanically activate and set the packing element, a plug may be run downhole to set the packing element using the hydraulic setting assembly.

While the well system 100 depicted in FIG. 1 illustrates a stationary drilling rig 110, one of ordinary skill in the art will readily appreciate that mobile workover rigs, wellbore servicing units (e.g., coiled tubing units), and the like may be similarly employed. Further, while the well system 100 depicted in FIG. 1 refers to a wellbore penetrating the earth's surface on dry land, it should be understood that one or more of the apparatuses, systems and methods illustrated herein may alternatively be employed in other operational environments, such as within an offshore wellbore operational environment for example, a wellbore penetrating subterranean formation beneath a body of water.

In one embodiment of the packer assembly 180, a hydraulic setting assembly is locked in a run position with a hydraulic locking mechanism. In some embodiments, the hydraulic locking mechanism may be a collet. The hydraulic locking mechanism is pressure activated to allow the packing element to be set when differential pressure is applied from uphole into tubing of the packer assembly 180. The hydraulic locking mechanism is configured to prevent mechanical deployment of the hydraulic setting assembly until internally applied pressure causes the hydraulic locking mechanism to release and become unsupported. This hydraulic locking mechanism may also allow the hydrostatic setting assembly to deploy independently even when the hydraulic setting assembly is locked.

The hydrostatic setting assembly may also be locked in the run position with at least one hydrostatic locking mechanism, in one embodiment, a collet. The hydrostatic locking mechanism prevents accidental deployment of the packing element before reaching a desired position within the wellbore. This hydrostatic locking mechanism prevents mechanical deployment of the hydrostatic setting assembly until absolute pressure is applied from pressure within the wellbore, bursting a rupture disc and applying pressure to a piston isolated from well fluids, which causes the hydrostatic locking mechanism to become unsupported and thereafter push a hydrostatic piston uphole to engage with a packing element activation sleeve to set the packing element. This hydrostatic locking mechanism may also allow the hydraulic setting assembly to deploy independently even when the hydrostatic setting assembly is locked.

Figure 2A:
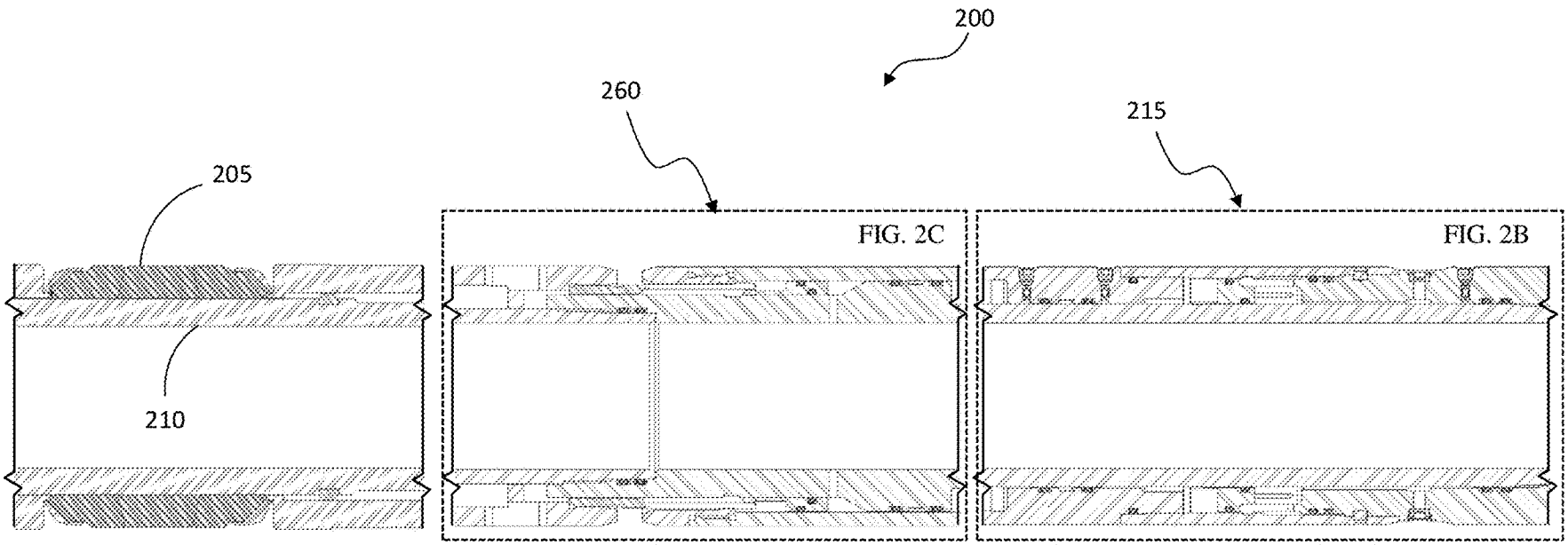
FIGS. 2A-2C illustrate one embodiment of a packer assembly according to the present disclosure which may be used with the well system of FIG. 1.
Figure 2B:
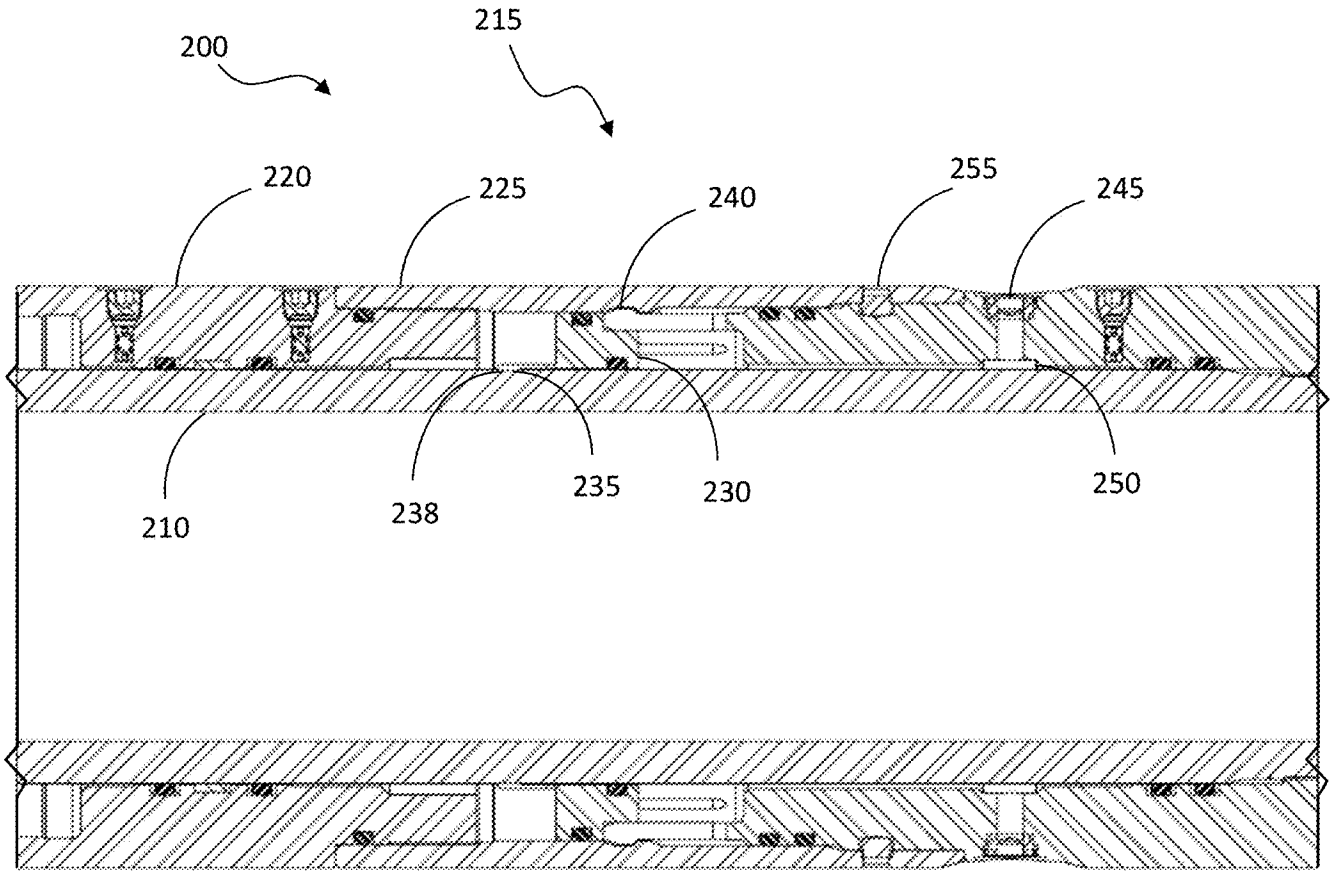
Figure 2C:
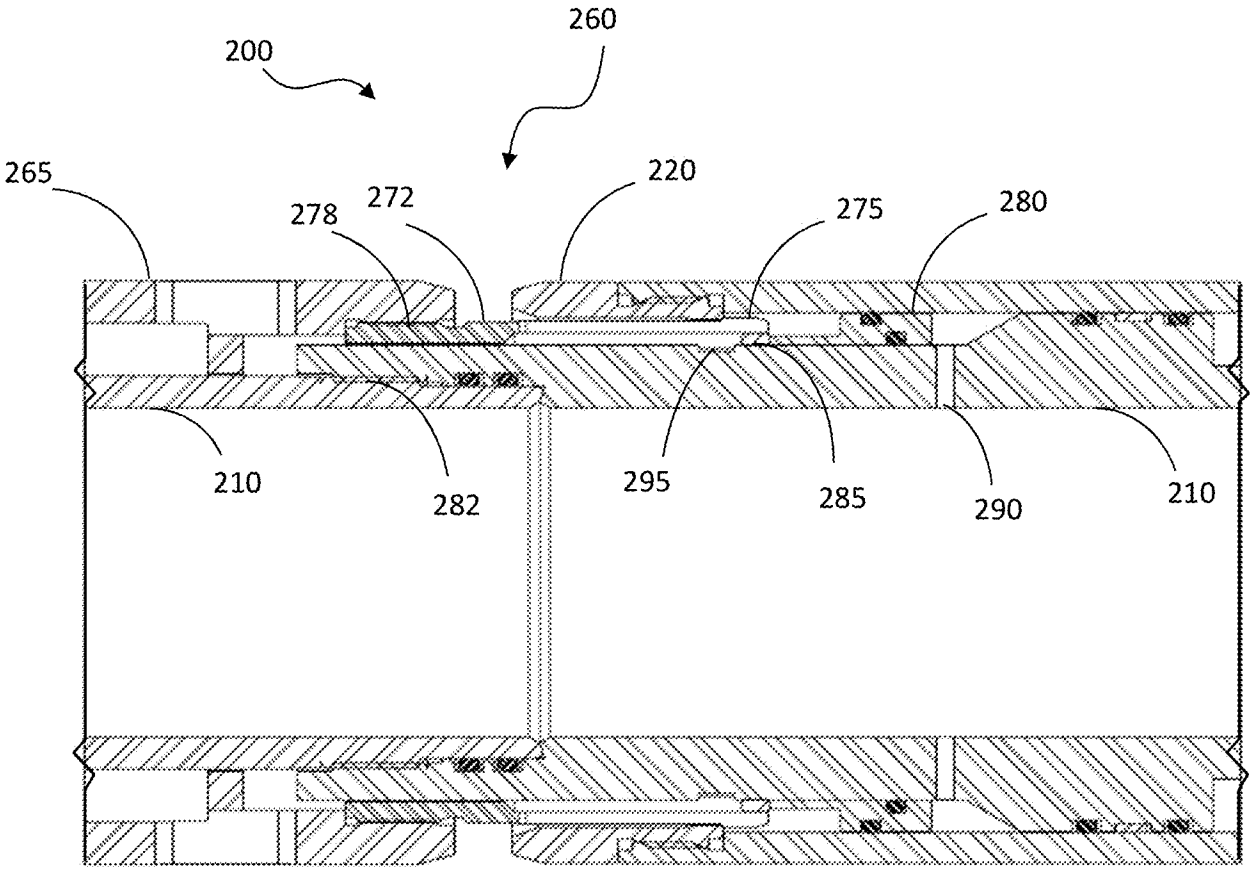

Turning to FIGS. 2A-2C, there is shown one embodiment of a packer assembly 200 which may be used with the well system 100 of FIG. 1. The packer assembly 200 is shown as assembled when being run downhole into the wellbore. The packer assembly 200 may include, in one embodiment a packing element 205, a hydrostatic setting assembly 215, and a hydraulic setting assembly 260. Each of the hydrostatic setting assembly 215 and the hydraulic setting assembly 260 may include independent locking mechanisms. The packing element 205, hydrostatic setting assembly 215 and the hydraulic setting assembly 260 at least partially surround an inner mandrel 210.

Referring now to FIG. 2B, in this embodiment, the hydrostatic setting assembly 215 includes at least a hydrostatic piston 220. In some embodiments, the hydrostatic piston 220 may include a lock sleeve 225 at a downhole end thereof. At an uphole end, the hydrostatic piston 220 may engage with the hydraulic setting assembly 260. Positioned axially between the inner mandrel 210 and the lock sleeve 225 may be a hydrostatic prop piston 230 and a hydrostatic locking mechanism 240, which in this embodiment is an outer collet. In other embodiments, the hydrostatic locking mechanism 240 may use other locking/holding devices such as, e.g., shearing devices, including shear pins, snap rings, and other suitable locking/holding devices. The hydrostatic prop piston 230, in this embodiment, also acts as a collet prop. In some embodiments, the hydrostatic prop piston 230 may include an inner hydrostatic locking mechanism 235, such as an inner collet which extends from an uphole end of the hydrostatic prop piston 230 into a space between the hydrostatic prop piston 230 and the lock sleeve 225. In other embodiments, the hydrostatic prop piston 230 may use a shear pin, snap ring, or other locking devices instead of a collet as the inner hydrostatic locking mechanism 235.

Once the packer assembly 200 reaches a desired positioned in the wellbore, pressure within the wellbore bursts a rupture disc 245 located beyond the distal end of the lock sleeve 225. Pressure travels through a series of pressure channels 250 and pushes the hydrostatic prop piston 230 (e.g., uphole in the illustrated embodiment), releasing the inner hydrostatic locking mechanism 235 (inner collet) from a groove 238 on an outer diameter of the inner mandrel 210. The hydrostatic prop piston 230 strokes uphole, which un-props and releases the hydrostatic locking mechanism 240 (outer collet) and shears shear screws 255. The hydrostatic prop piston 230 then contacts the hydrostatic piston 220, whereafter the hydrostatic piston 220 and lock sleeve 225 may stroke uphole and engage a packing element activation sleeve, in some embodiments a push sleeve. The packing element activation sleeve then engages the packing element 205, thereby setting the packing element 205 outward to engage the casing of the wellbore.

Referring now to FIG. 2C, there is shown the hydraulic setting assembly 260. If the hydrostatic setting assembly 215 fails to activate and set the packing element 205, the hydraulic setting assembly 260 may be used as a backup method for setting the packing element 205 without removing the packer assembly 200 from the wellbore. Packing element activation sleeve 265, in this embodiment, a push sleeve, at least partially surrounds the inner mandrel 210. In some embodiments, the inner mandrel 210 may include a plurality of sections, which may be coupled by threaded connections such as threaded connection 282. Positioned axially between the inner mandrel 210 and the hydrostatic piston 215 is a hydraulic piston 272 and a hydraulic locking mechanism 275, which in this embodiment, is an outer collet. In other embodiments, the hydraulic locking mechanism 275 may be other forms of locking/holding devices such as e.g., shear pins and snap rings. In some embodiments, the hydraulic piston 272 and hydraulic locking mechanism 275 may be coupled together. The hydraulic piston 272 may be coupled at its uphole end with the packing element activation sleeve 265 by a threaded connection 278. In some embodiments, the hydraulic locking mechanism 275 may be held in place at its downhole end by a hydraulic prop piston 280. In one embodiment, the hydraulic prop piston 280 may include a piston locking mechanism 285 extending from its uphole end. In this embodiment, the piston locking mechanism 285 is a snap ring, but other locking devices may be used such as, e.g., a collet or a shear pin or other shear feature.

If the hydrostatic setting assembly 215 fails to activate, a plug may be run downhole to apply differential pressure and activate the hydraulic setting assembly 260. Pressure comes through at least pressure channel 290, which acts on the hydraulic prop piston 280. As the hydraulic prop piston 280 moves, in this embodiment, uphole, the piston locking mechanism 285 (inner collet) may release inward toward the inner mandrel 210 into a slot 295. Once the piston locking mechanism 285 is released, the hydraulic locking mechanism 275 releases from a locked position with the hydrostatic piston 220 to an unlocked position. The packing element activation sleeve 265 may then stroke uphole and pressure acting on the hydraulic setting assembly 260 through at least pressure channel 290 and additional openings (not shown) uphole of hydraulic setting assembly 260, may act on the packing element activation sleeve 265, pushing packing element activation sleeve 265 uphole to engage the packing element 205. The packing element 205 may then move radially outward into engagement with the wellbore casing.

Figure 3A:
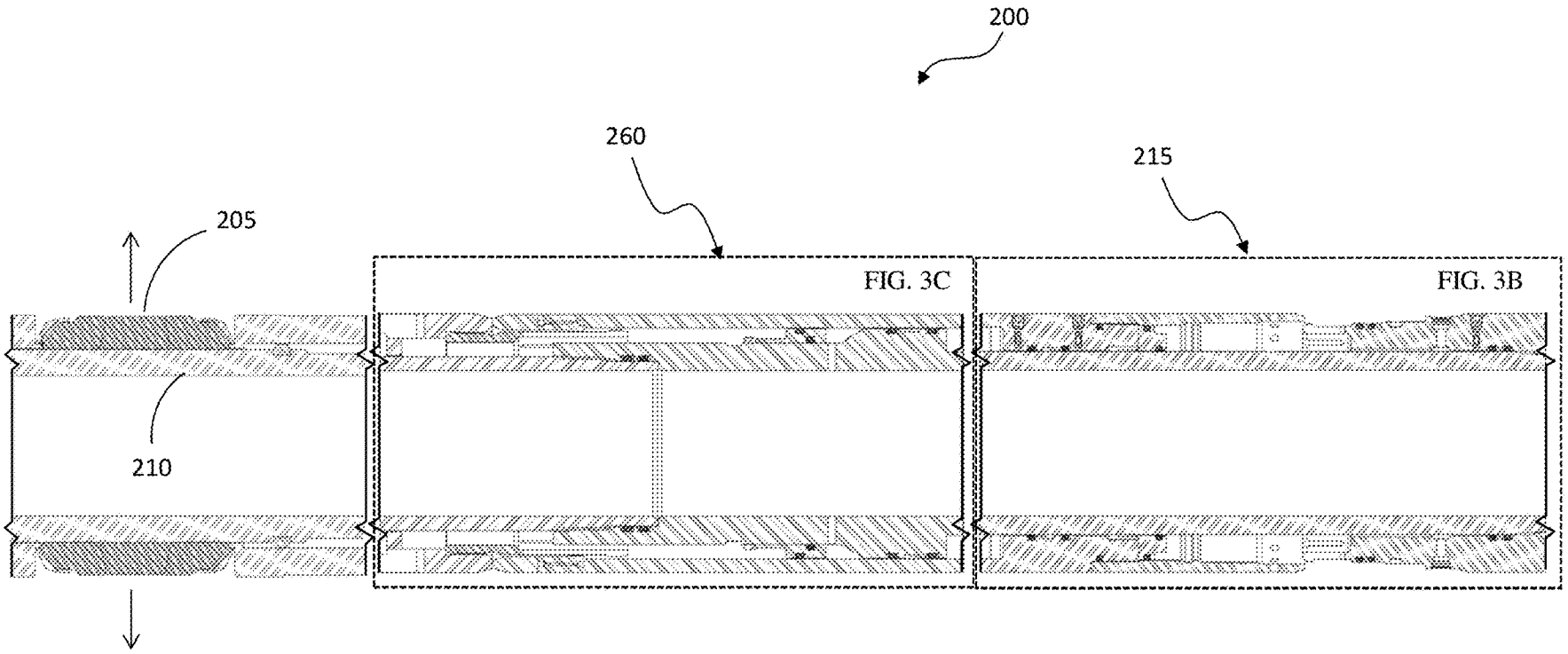
FIGS. 3A-3C illustrate the packer assembly of FIG. 2A-2C shown upon activation of a hydrostatic setting assembly.
Figure 3B:
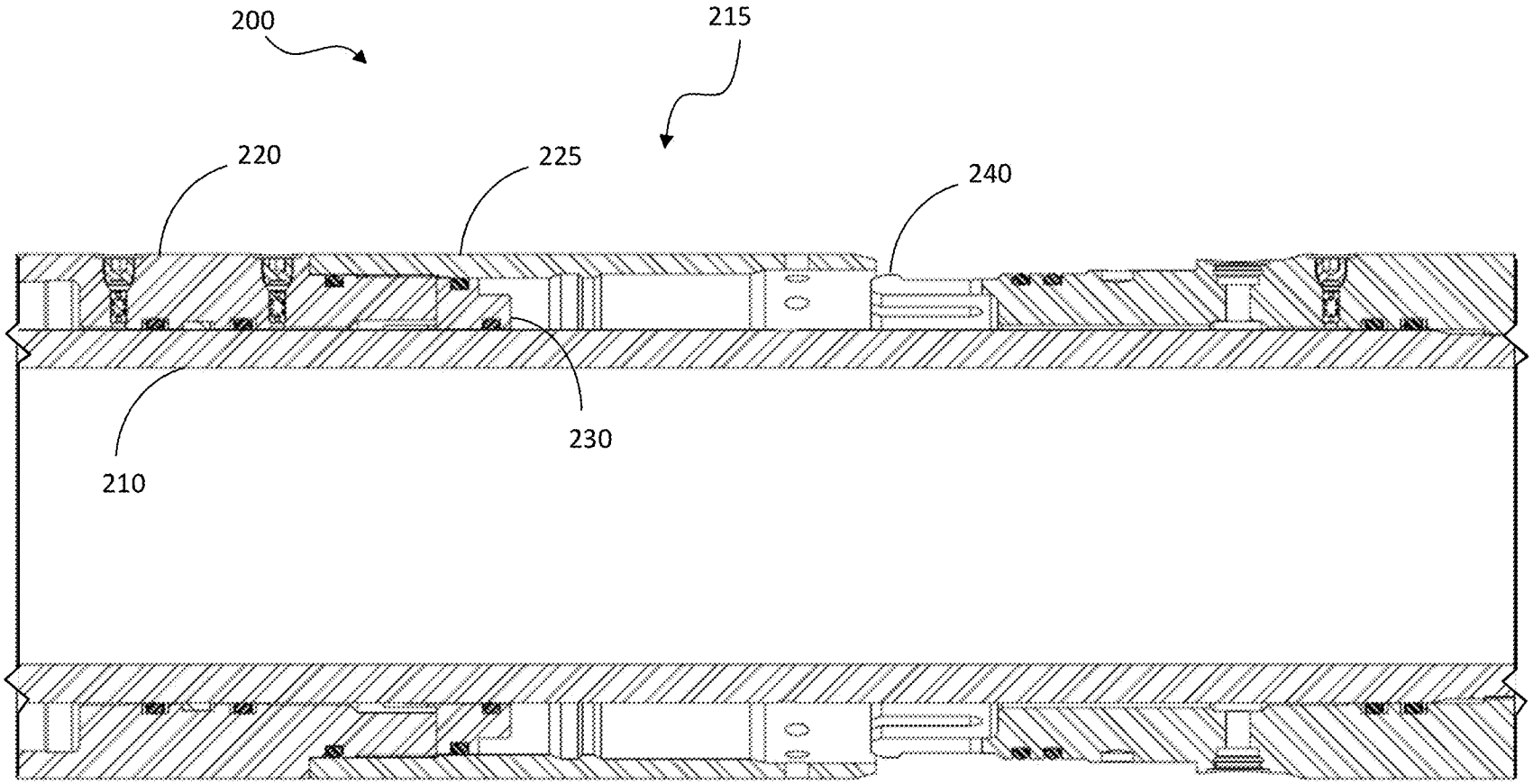
Figure 3C:
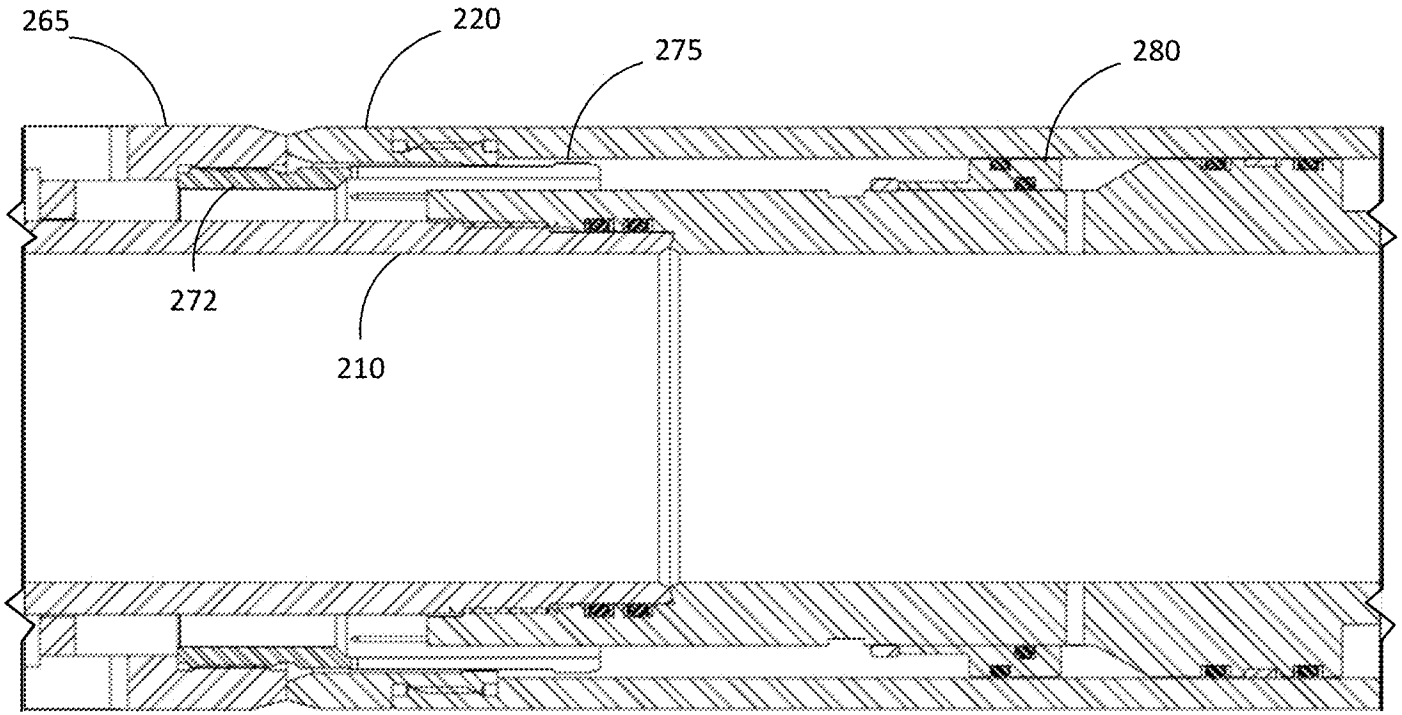

Referring now to FIGS. 3A-3C, there are shown views of the packer assembly 200 after the hydrostatic setting assembly 215 has been activated such that the packing element 205 may be set radially outward. FIG. 3B illustrates the hydrostatic setting assembly 215 in a mechanically activated state, wherein, the hydrostatic prop piston 230 has stroked uphole, releasing hydrostatic locking mechanism 240. The hydrostatic piston 220 has stroked upward and engaged the packing element activation sleeve 265. As shown in FIG. 3C, the hydraulic piston 272 and hydraulic locking mechanism 275 remain coupled with the packing element activation sleeve 265, but are no longer engaged with the hydrostatic piston 220. The hydraulic prop piston 280 remains in a relatively unchanged position.

Figure 4A:
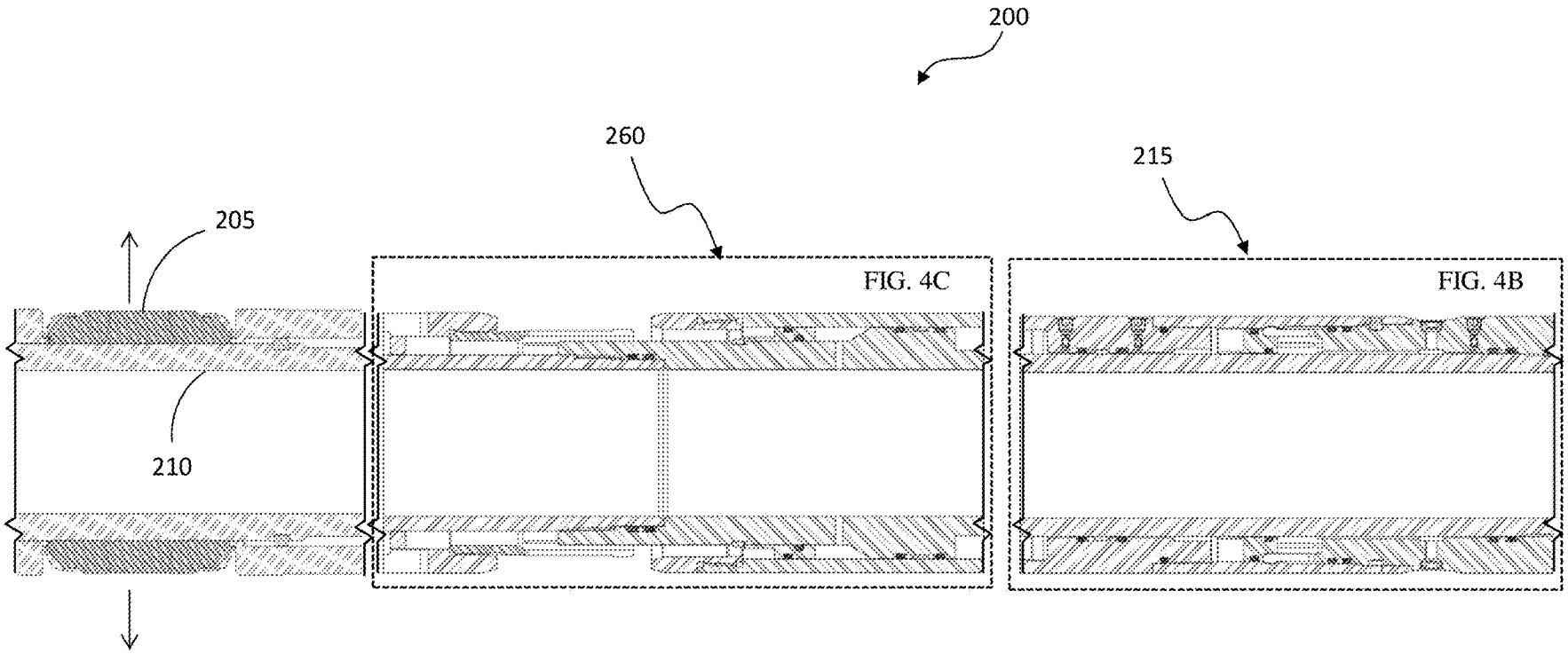
FIGS. 4A-4C illustrate the packer assembly of FIG. 2A-2C shown upon activation of a hydraulic setting assembly.
Figure 4B:
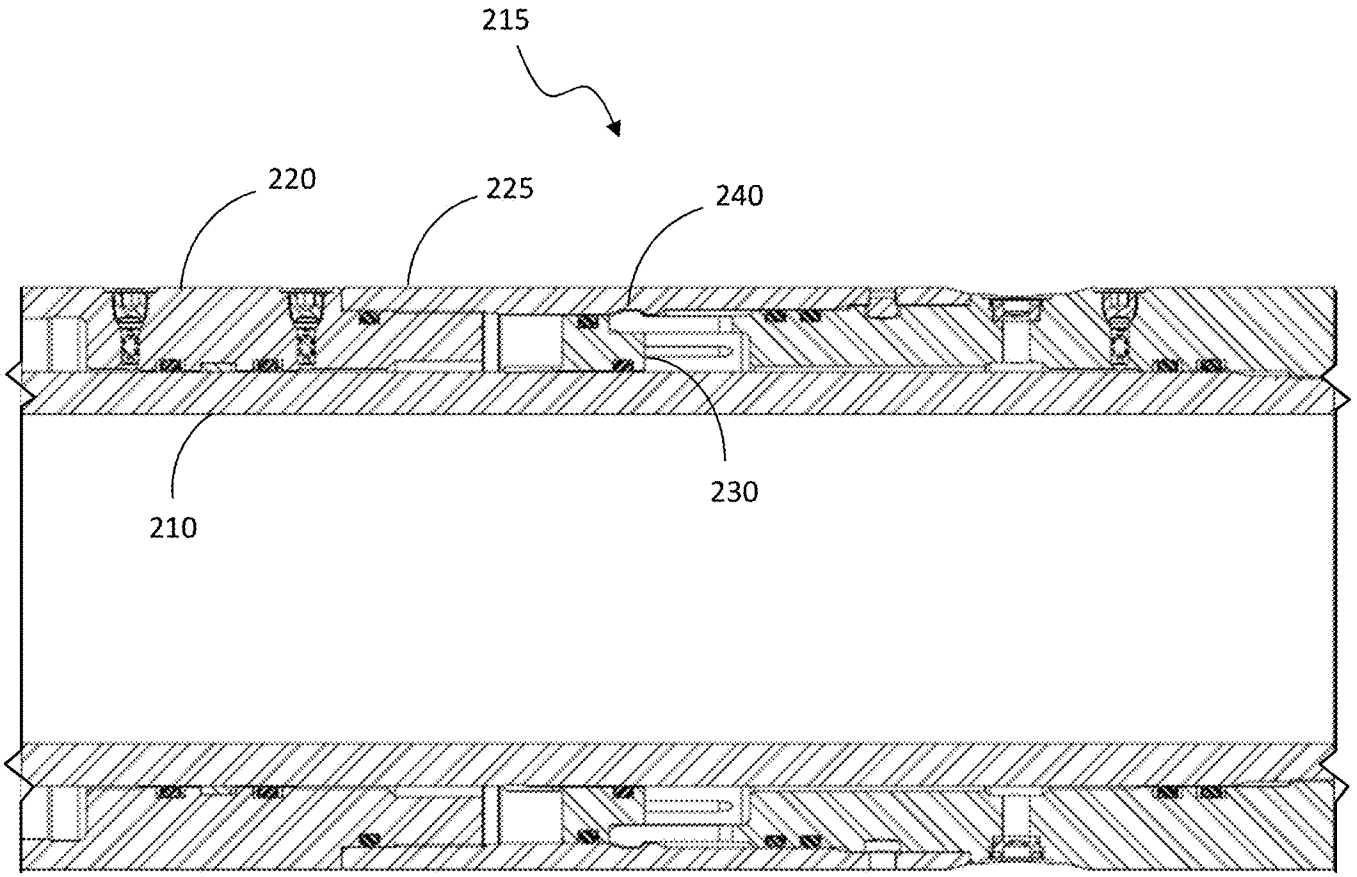
Figure 4C:
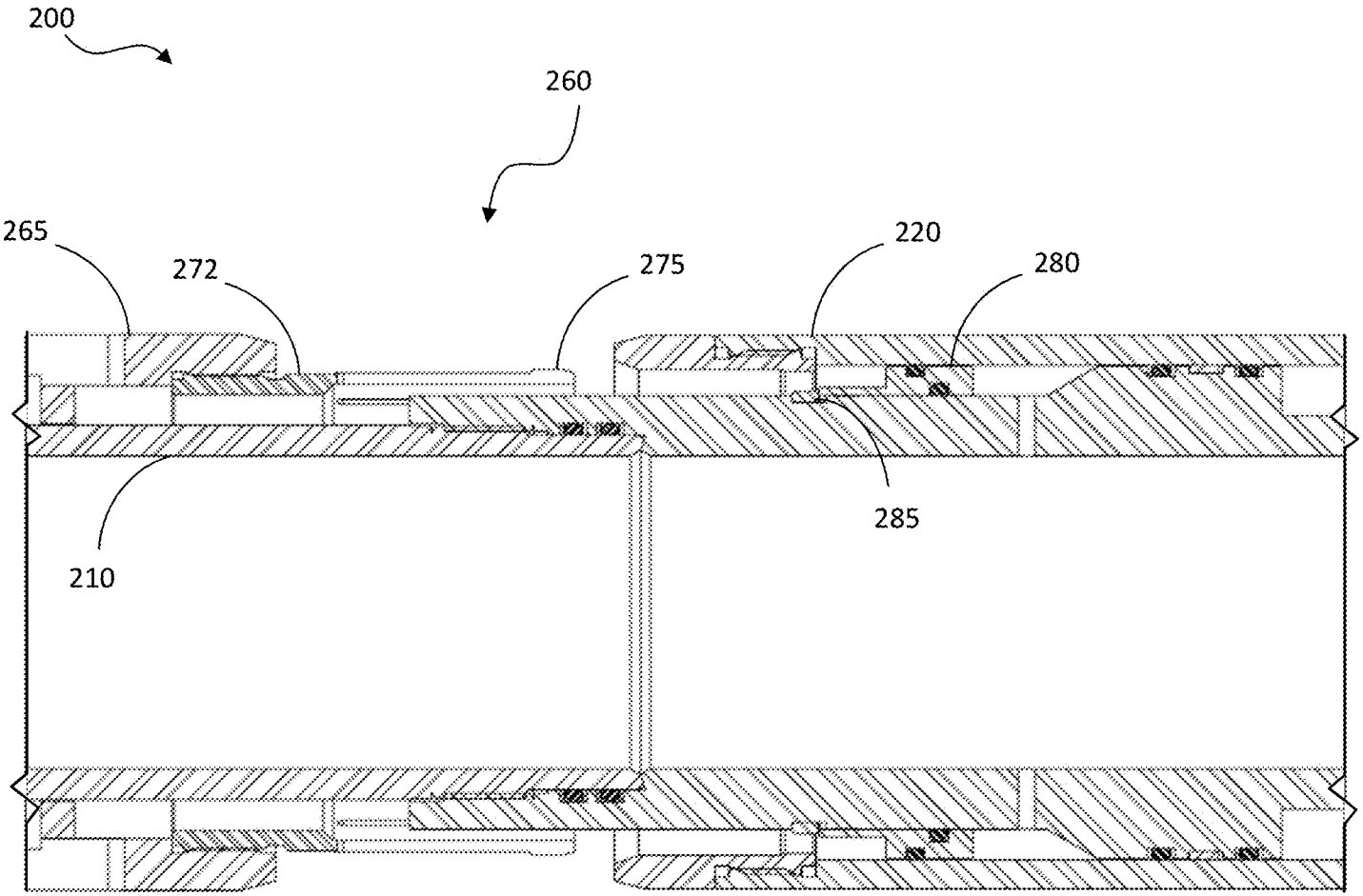

Referring now to FIGS. 4A-4C, there are shown views of the packer assembly 200 after the hydraulic setting assembly 260 has been activated, such that the packing element 205 may be set radially outward. As shown in FIG. 4B, the hydrostatic setting assembly 215 remains unchanged. FIG. 4C shows the hydraulic setting assembly 260 in a mechanically activated state. The piston locking mechanism 285 has been released and the hydraulic prop piston 280 moved uphole, releasing the hydraulic locking mechanism 275 from engagement with the hydrostatic piston 220. The packing element activation sleeve 265 has been released and may then move uphole to engage the packing element 205 while the hydrostatic piston 220 remains in an relatively unchanged, un-activated position.

Figure 5A:
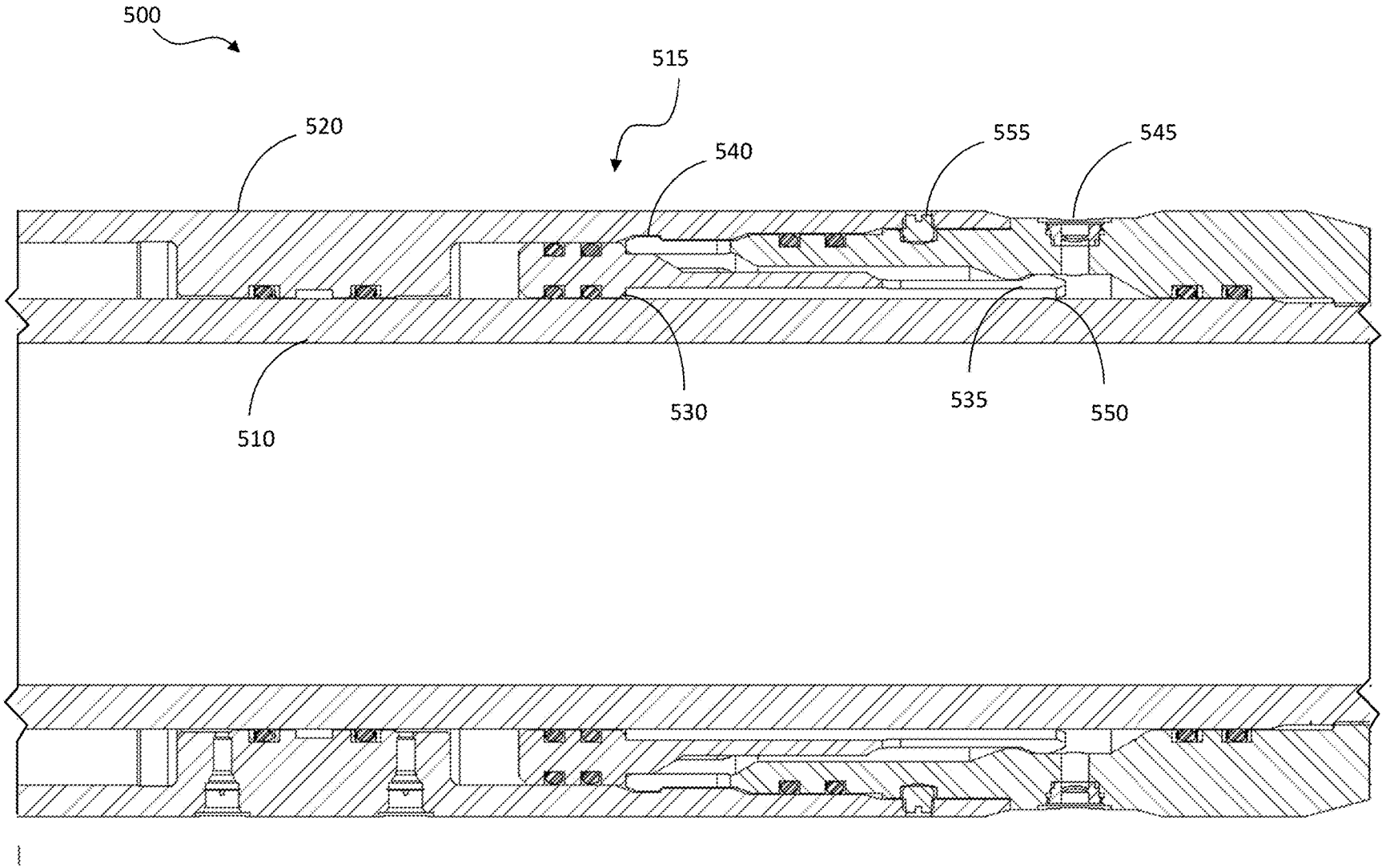
FIGS. 5A-5B illustrate another embodiment of a packer assembly according to the present disclosure which may be used with the well system of FIG. 1.
Figure 5B:
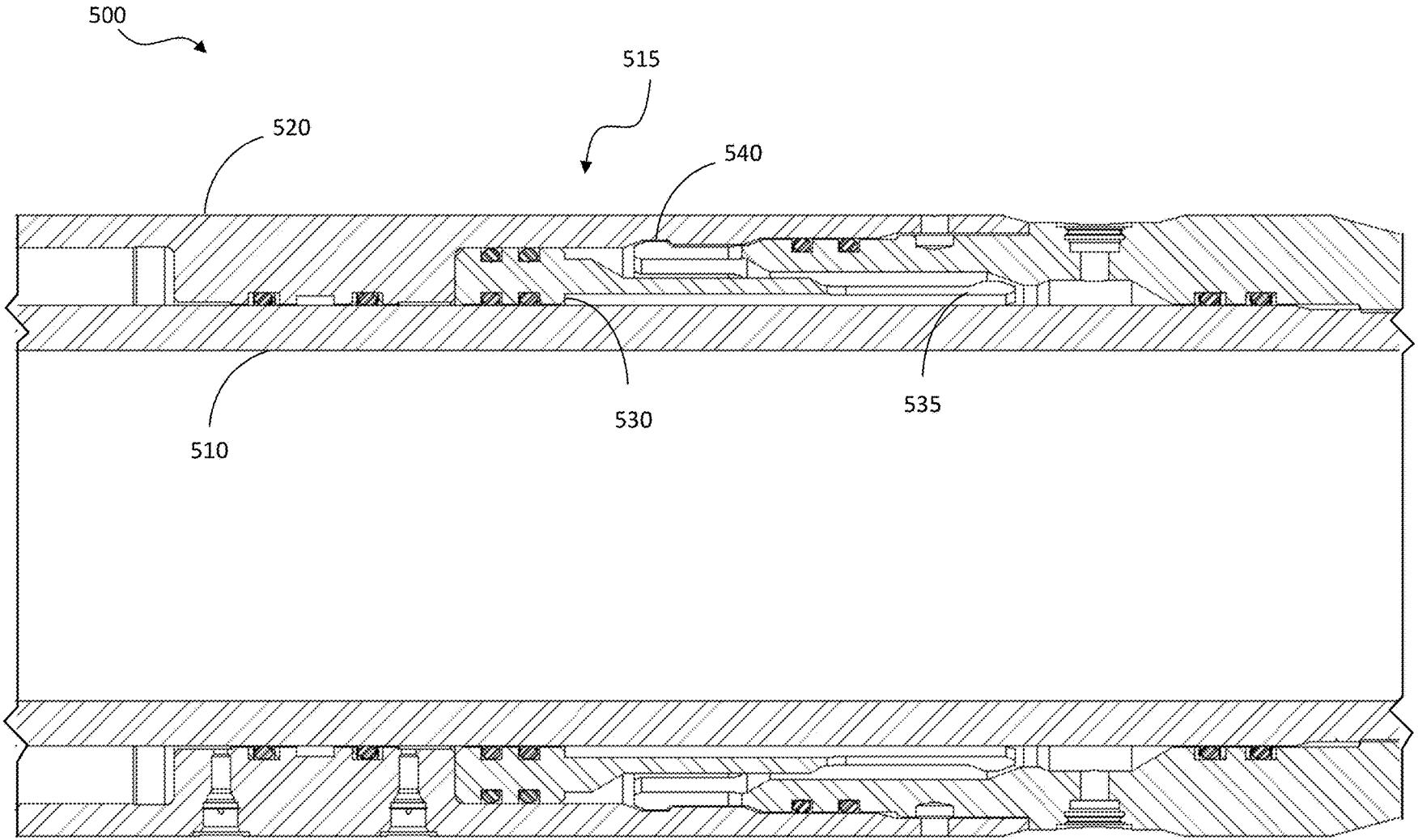

Referring now to FIGS. 5A and 5B, there is shown another embodiment of a packer assembly 500 according to the disclosure. The packer assembly 500 similarly includes a hydrostatic setting assembly 515, a hydraulic setting assembly (not shown), and a packing element (not shown). The hydraulic setting assembly, in this embodiment, may be configured similarly to hydraulic setting assembly 260 shown and described hereinabove. Referring now to FIG. 5A, there is shown the hydrostatic setting assembly 515 in a propped, or mechanically un-activated state such as when the packer assembly 500 is run into the wellbore. The hydrostatic setting assembly 515, in this embodiment, includes a hydrostatic piston 520 and an inner mandrel 510. Positioned between the hydrostatic piston 520 and the inner mandrel 510 is hydrostatic prop piston 530 having a first locking mechanism 535 and a second locking mechanism 540. In this embodiment, both of the first and second locking mechanisms 535 and 540 are collets, but other locking devices may be used, such as, e.g., shearing devices. When the packer assembly 500 reaches a desired location in the wellbore, absolute pressure within the wellbore bursts rupture disc 545. Pressure continues through pressure channel 550 and acts on the hydrostatic prop piston 530, which releases the first and second locking mechanisms 535 and 540. Once the second locking mechanism 540 is released, the hydrostatic piston 520 may then stroke uphole when engaged by the hydrostatic prop piston 530. The hydrostatic piston 520, may then stroke uphole to engage a packing element activation sleeve, which may then stroke uphole to engage the packing element. In some embodiments, the hydrostatic piston 520 may also include an additional locking element, such as a shear feature 555, which may shear at a substantially similar pressure amount as needed to act upon the hydrostatic prop piston 530 and release the first a second locking mechanisms 535 and 540. As used herein, the term substantially similar pressure means within 0-10% of an amount of pressure.

In some embodiments, the amount of pressure to release the first a second locking mechanisms 535 and 540 may be similar to the amount of pressure needed to release shearing screws used in hydrostatic packer assemblies. The amount of pressure may vary according to the assembly and function of the packer assembly.

FIG. 5B illustrates the hydrostatic setting assembly 515 in an un-propped, or mechanically activated state. The first and second locking mechanisms 535 and 540 are shown released and the hydrostatic prop piston and the hydrostatic piston 520 have stroked uphole.

Figure 6A:
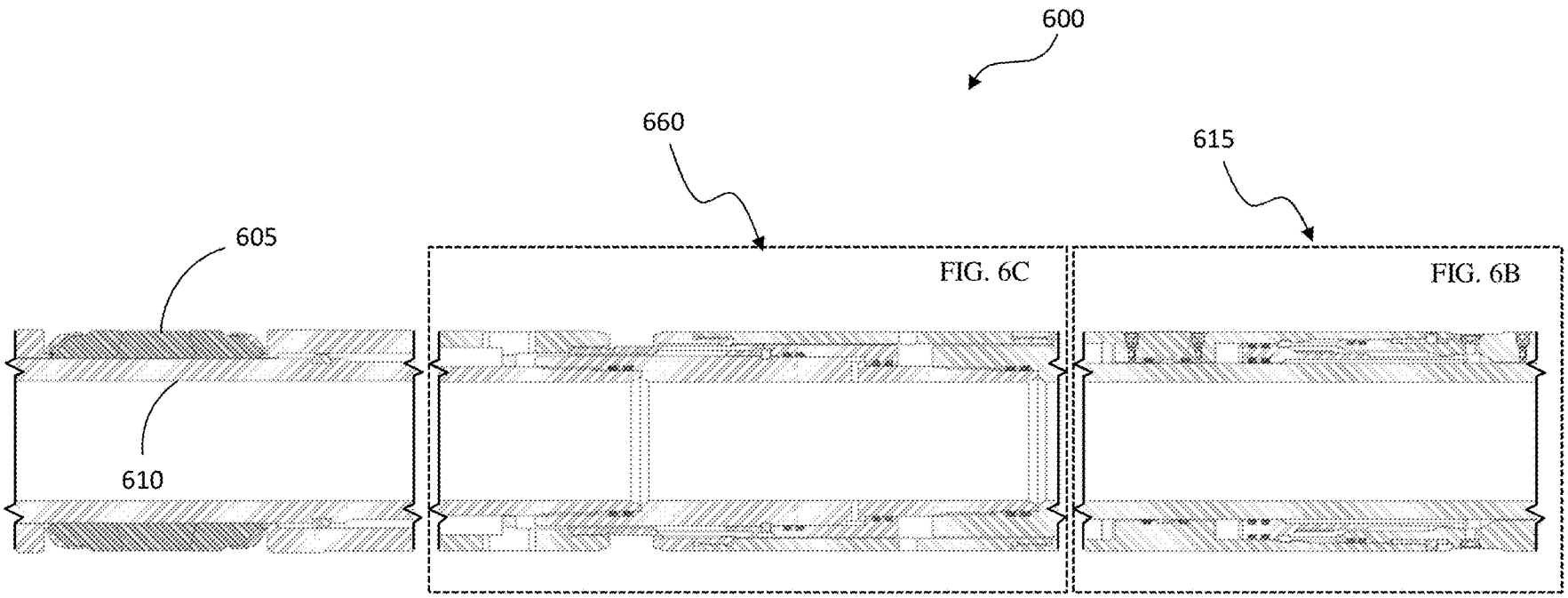
FIGS. 6A-6C illustrate yet another embodiment of a packer assembly according to the present disclosure which may be used with the well system of FIG. 1.
Figure 6B:
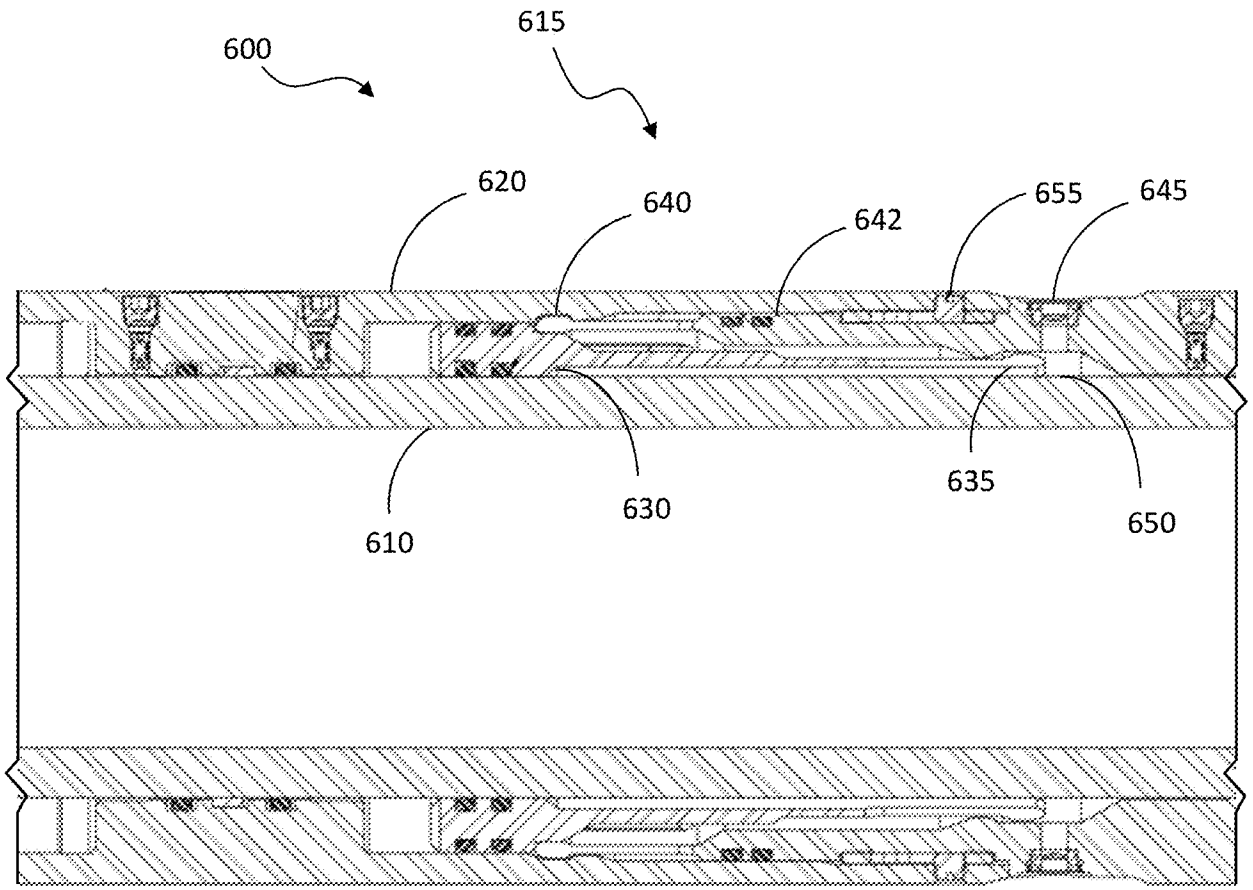
Figure 6C:
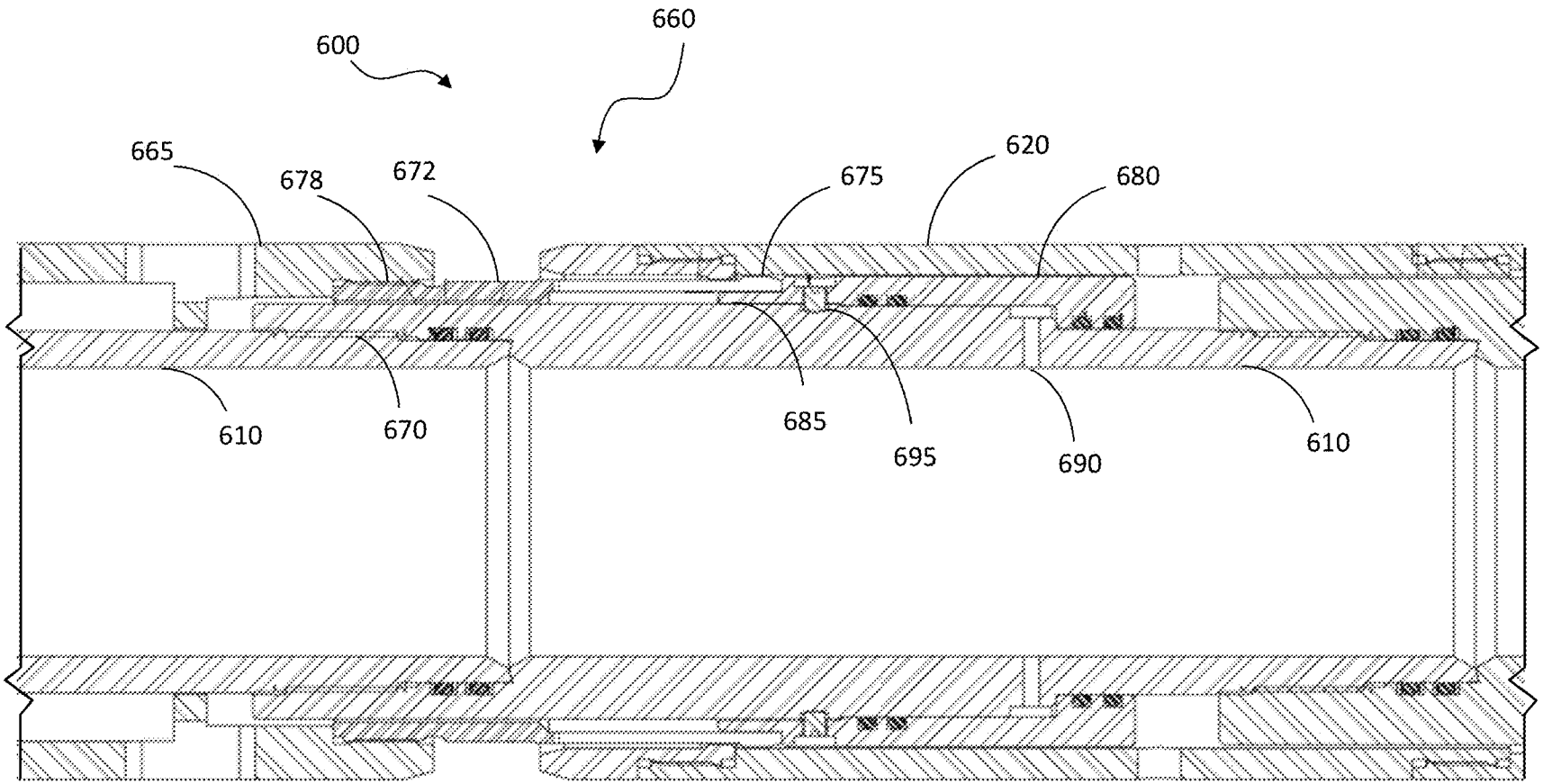

Referring now to FIGS. 6A-6C, there is shown another embodiment of a packer assembly 600 which may be used in a wellbore. The packer assembly 600 may include, in one embodiment a packing element 605, a hydrostatic setting assembly 615, and a hydraulic setting assembly 660. Each of the hydrostatic setting assembly 615 and the hydraulic setting assembly 660 may include independent locking mechanisms. The packing element 605, hydrostatic setting assembly 615 and the hydraulic setting assembly 660 may at least partially surround an inner mandrel 610.

Referring now to FIG. 6B, in this embodiment, the hydrostatic setting assembly 615 includes a hydrostatic piston 620. At an uphole end, the hydrostatic piston 620 may engage with the hydraulic setting assembly 660. Positioned axially between the inner mandrel 610 and the hydrostatic piston 620 may be a hydrostatic prop piston 630. In some embodiments, the hydrostatic prop piston 630 may include a first hydrostatic locking mechanism 635, which in this embodiment, is an inner collet. The hydrostatic setting assembly 615, in this embodiment, includes a second hydrostatic locking mechanism 640, which in this embodiment is an outer collet. In other embodiments, the first and second hydrostatic locking mechanisms 635 and 640 may be other locking/holding devices such as, e.g., shearing devices, including shear pins, snap rings, and other suitable locking/holding devices. The second hydrostatic locking mechanism 640 may be coupled with a locking mandrel 642, which may be coupled with hydrostatic shear feature 655, which in this embodiment, is a shear pin. Other embodiments may use alternative shear features, such as, e.g., shear screws or a snap ring.

Once the packer assembly 600 reaches a desired positioned into the wellbore, vacuum seals are released from the hydrostatic setting assembly 615 which enables pressure within the wellbore to burst a rupture disc 645 located beyond the distal end of the hydrostatic piston 620. Pressure travels through a series of pressure channels 650 and acts on the hydrostatic prop piston 630 (e.g., uphole in the illustrated embodiment) and the first hydrostatic locking mechanism 635, releasing the first hydrostatic locking mechanism 635

(inner collet) from engagement with the locking mandrel 642. The hydrostatic prop piston 630 strokes uphole, which un-props and releases the second hydrostatic locking mechanism 640 (outer collet) and shears hydrostatic shear feature 655. The hydrostatic prop piston 630 then contacts the hydrostatic piston 620, whereafter the hydrostatic piston 620 may stroke uphole and engage a packing element activation sleeve, in some embodiments a push sleeve. The packing element activation sleeve then engages the packing element 605, thereby setting the packing element 605 outward to engage the casing of the wellbore.

Referring now to FIG. 6C, there is shown the hydraulic setting assembly 660. If the hydrostatic setting assembly 615 fails to activate and set the packing element 605, the hydraulic setting assembly 660 may be used as a backup method for setting the packing element 605 without removing the packer assembly 600 from the wellbore. Packing element activation sleeve 665, in this embodiment, a push sleeve, at least partially surrounds the inner mandrel 610. In some embodiments, the inner mandrel 610 may include a plurality of sections, which may be coupled by threaded connections such as threaded connection 670. Positioned axially between the inner mandrel 610 and the hydrostatic piston 620 is a hydraulic piston 672 coupled with a hydraulic locking mechanism 675, which in this embodiment, is an outer collet. In other embodiments, the hydraulic locking mechanism 675 may be other forms of locking/holding devices such as e.g., shear pins, shear screws, and snap rings. In some embodiments, the hydraulic piston 672 and hydraulic locking mechanism 675 may be incorporated together as a single feature. The hydraulic piston 672 may be coupled at its uphole end with the packing element activation sleeve 665 by a threaded connection 678. In some embodiments, the hydraulic locking mechanism 675 may be held in place at its downhole end by a hydraulic prop piston 680. In one embodiment, the hydraulic prop piston 680 may include a piston locking mechanism 685 extending from its uphole end.

If the hydrostatic setting assembly 615 fails to activate, a plug may be run downhole to apply differential pressure and activate the hydraulic setting assembly 660. Pressure comes through at least pressure channel 690, which acts on the hydraulic prop piston 680. As the hydraulic prop piston 680 moves, in this embodiment, downhole, the piston locking mechanism 685 releases from engagement with the hydraulic locking mechanism 675, thereby releasing the hydraulic locking mechanism 675 from a locked position with the hydrostatic piston 620 to an unlocked position. The packing element activation sleeve 665 may then stroke uphole. Pressure acting on the hydraulic setting assembly 660 through at least pressure channel 690 and additional openings (not shown) uphole of hydraulic setting assembly 660, may act on the packing element activation sleeve 665, pushing packing element activation sleeve 665 uphole to engage the packing element 605. The packing element 605 may then move radially outward into engagement with the wellbore casing. In some embodiments, the hydraulic prop piston 680 may also include a hydraulic shear feature 695 which may shear upon pressure acting on the hydraulic prop piston 680. The additional hydraulic shear feature 695 may be used, for example, to provide an additional locking element for the hydraulic prop piston 680

Figure 7A:
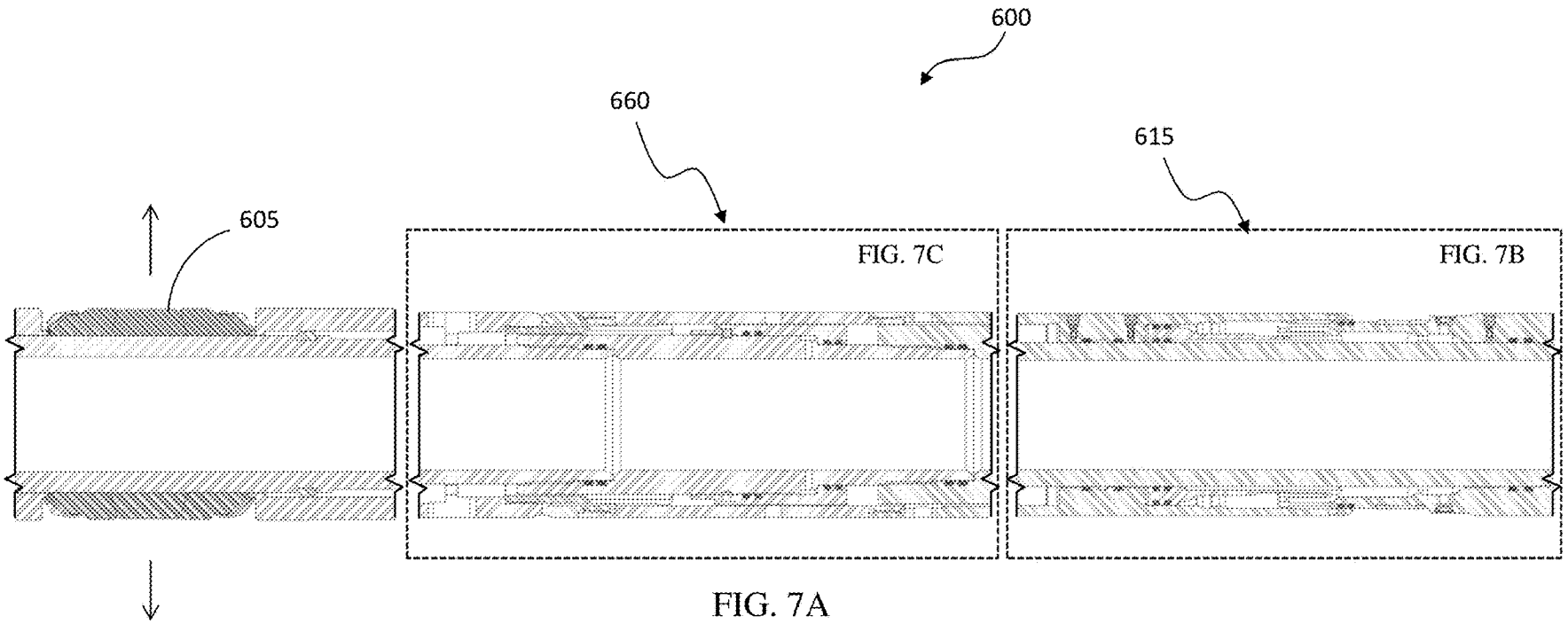
FIGS. 7A-7C illustrate the packer assembly of FIG. 6A-6C shown upon activation of a hydrostatic setting assembly.
Figure 7B:
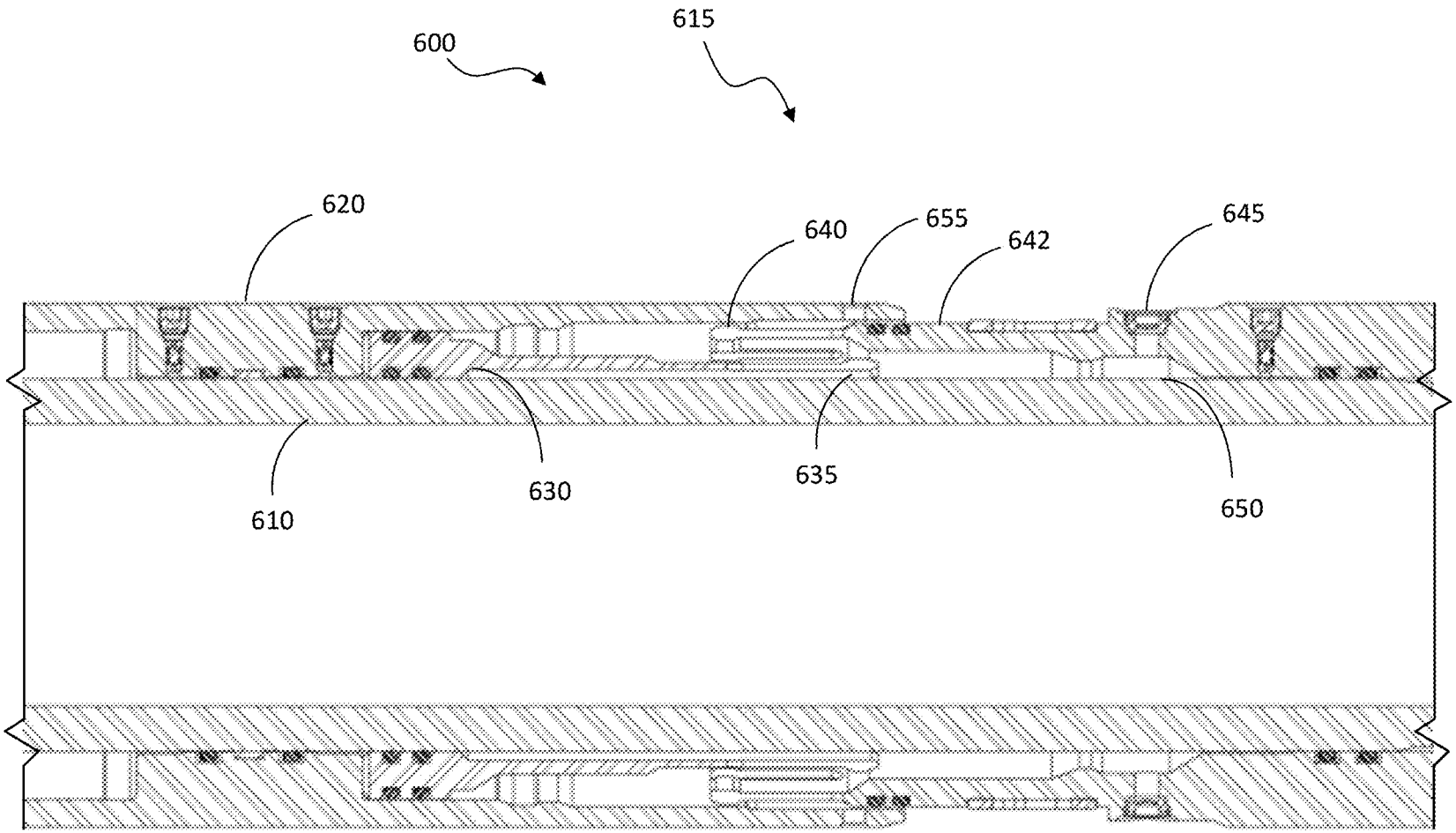
Figure 7C:
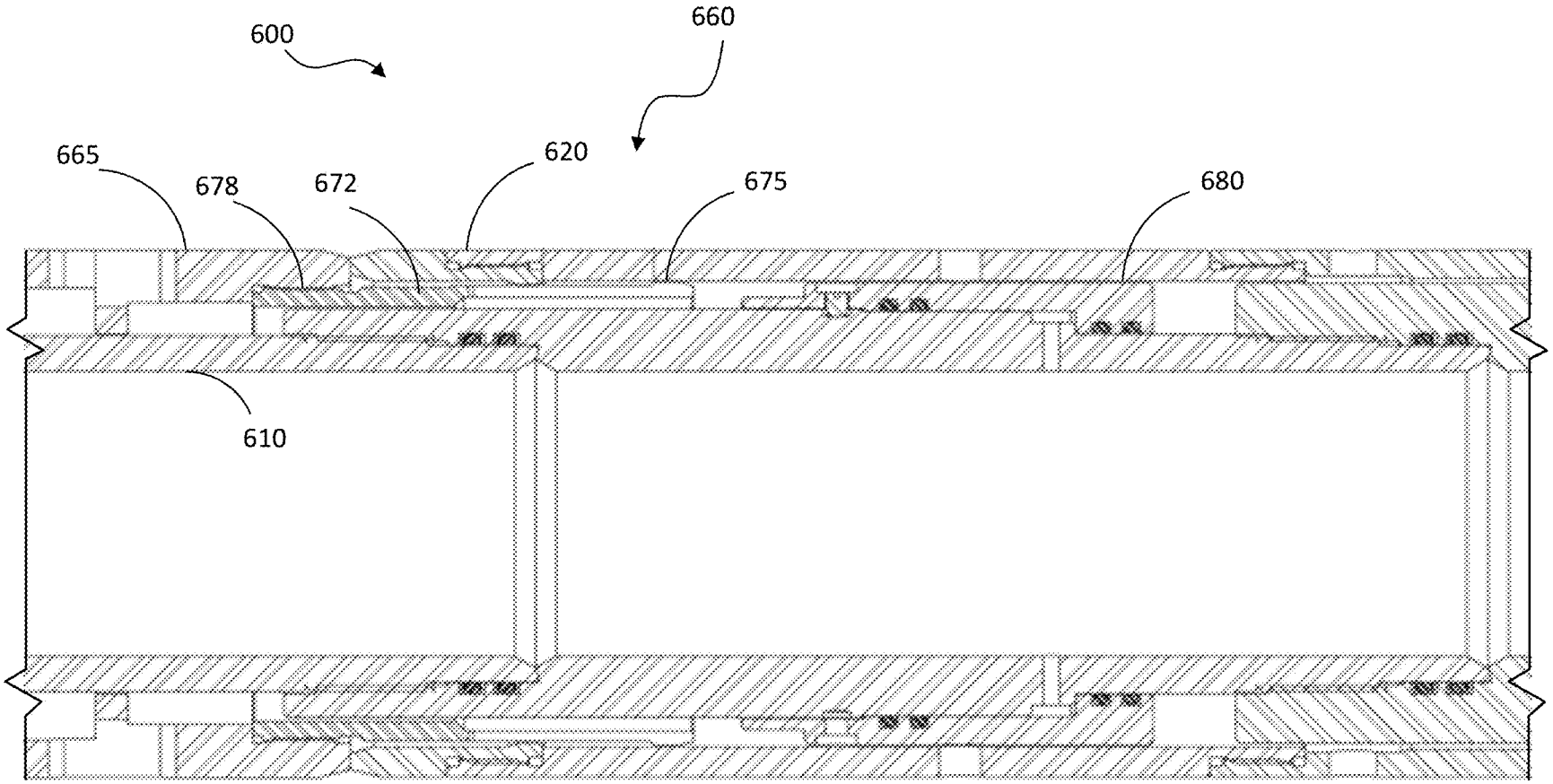

Referring now to FIGS. 7A-7C, there are shown views of the packer assembly 600 after the hydrostatic setting assembly 615 has been activated such that the packing element 605 may be set radially outward. FIG. 7B illustrates the hydrostatic setting assembly 615 in a mechanically activated state, wherein, the first hydrostatic locking mechanism 635 has been released, the hydrostatic prop piston 630, in this embodiment, has stroked uphole, thereby releasing second hydrostatic locking mechanism 640. Hydrostatic shear feature 655 has sheared and the hydrostatic piston 620 has stroked uphole to engage the packing element activation sleeve 665.

As shown in FIG. 7C, the hydraulic piston 672 and hydraulic locking mechanism 675 remain coupled with the packing element activation sleeve 665, but are no longer engaged with the hydrostatic piston 620. The hydraulic prop piston 680 remains in a relatively unchanged position.

Figure 8A:
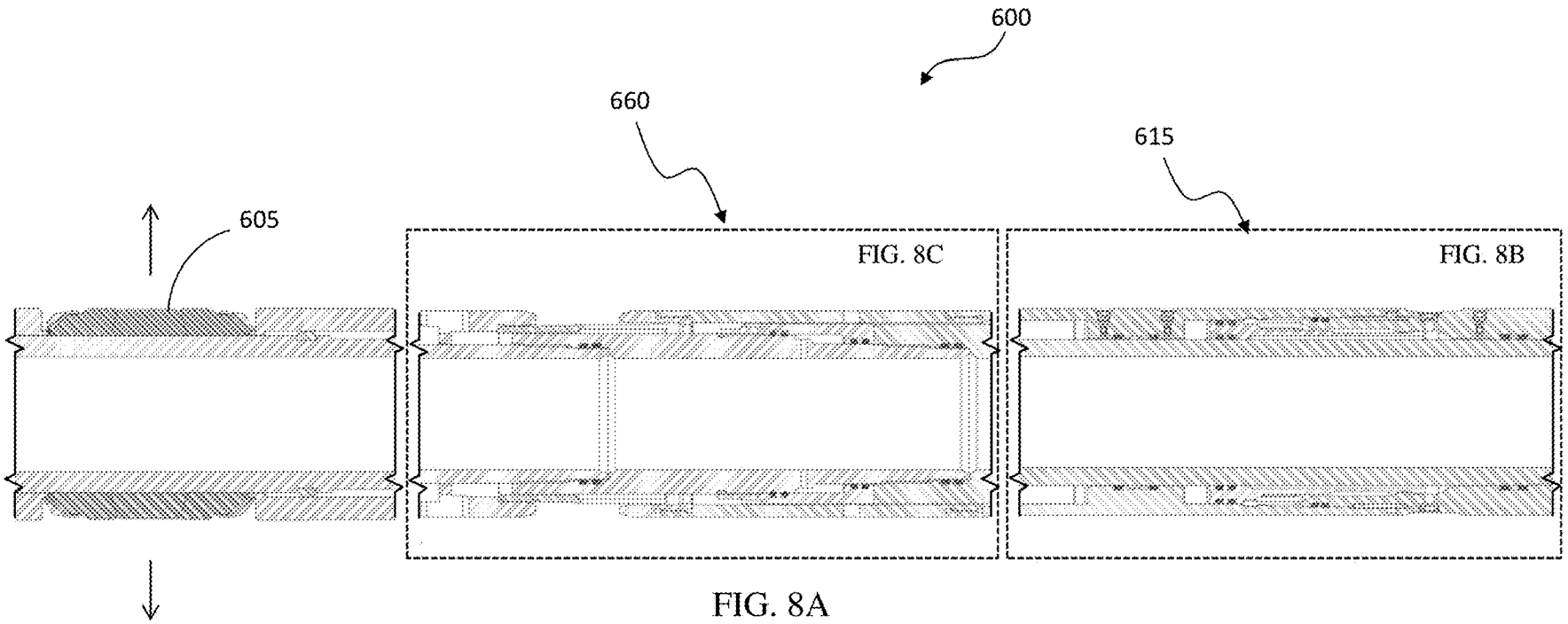
FIGS. 8A-8C illustrate the packer assembly of FIG. 6A-6C shown upon activation of a hydraulic setting assembly.
Figure 8B:
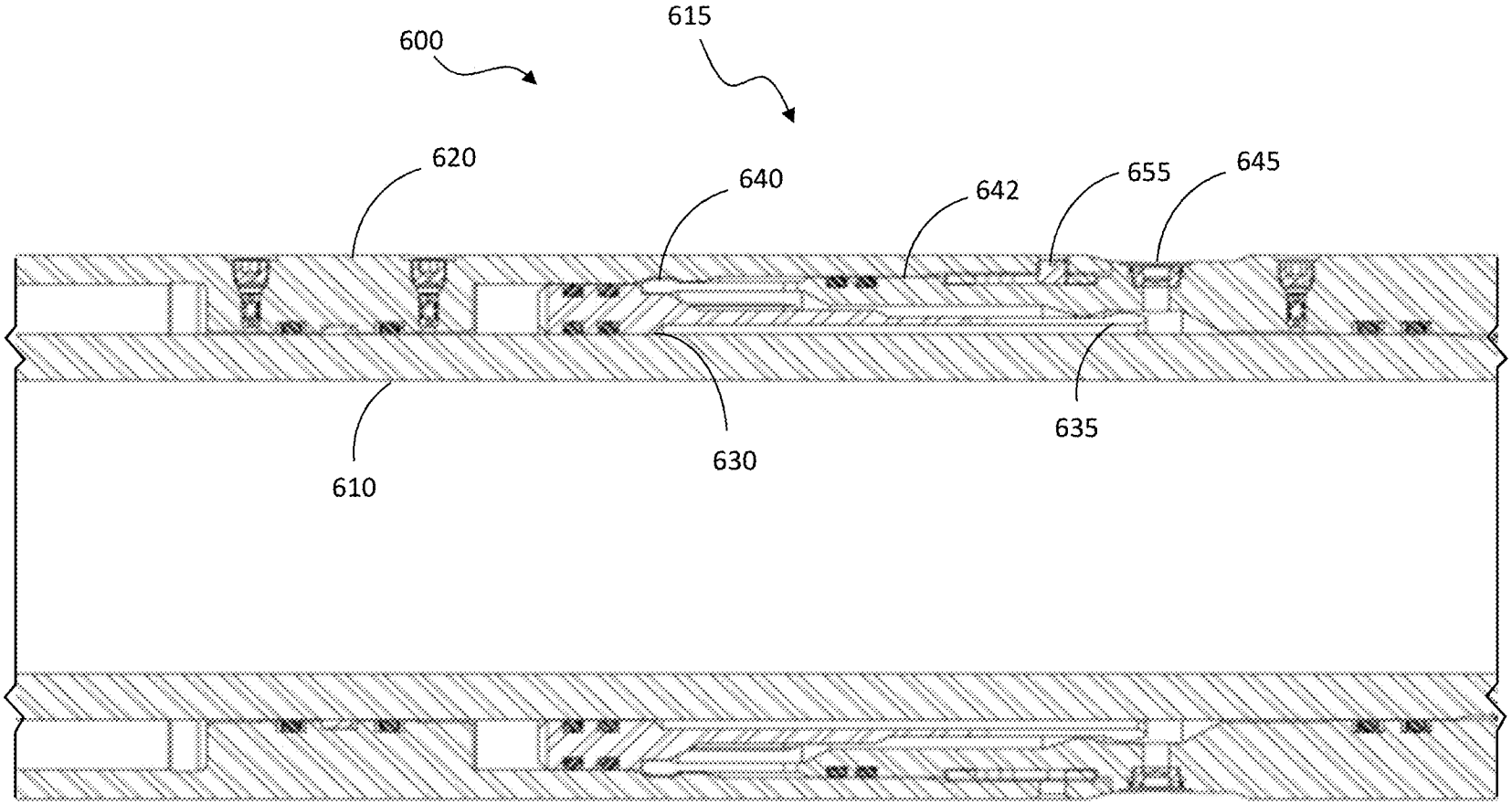
Figure 8C:
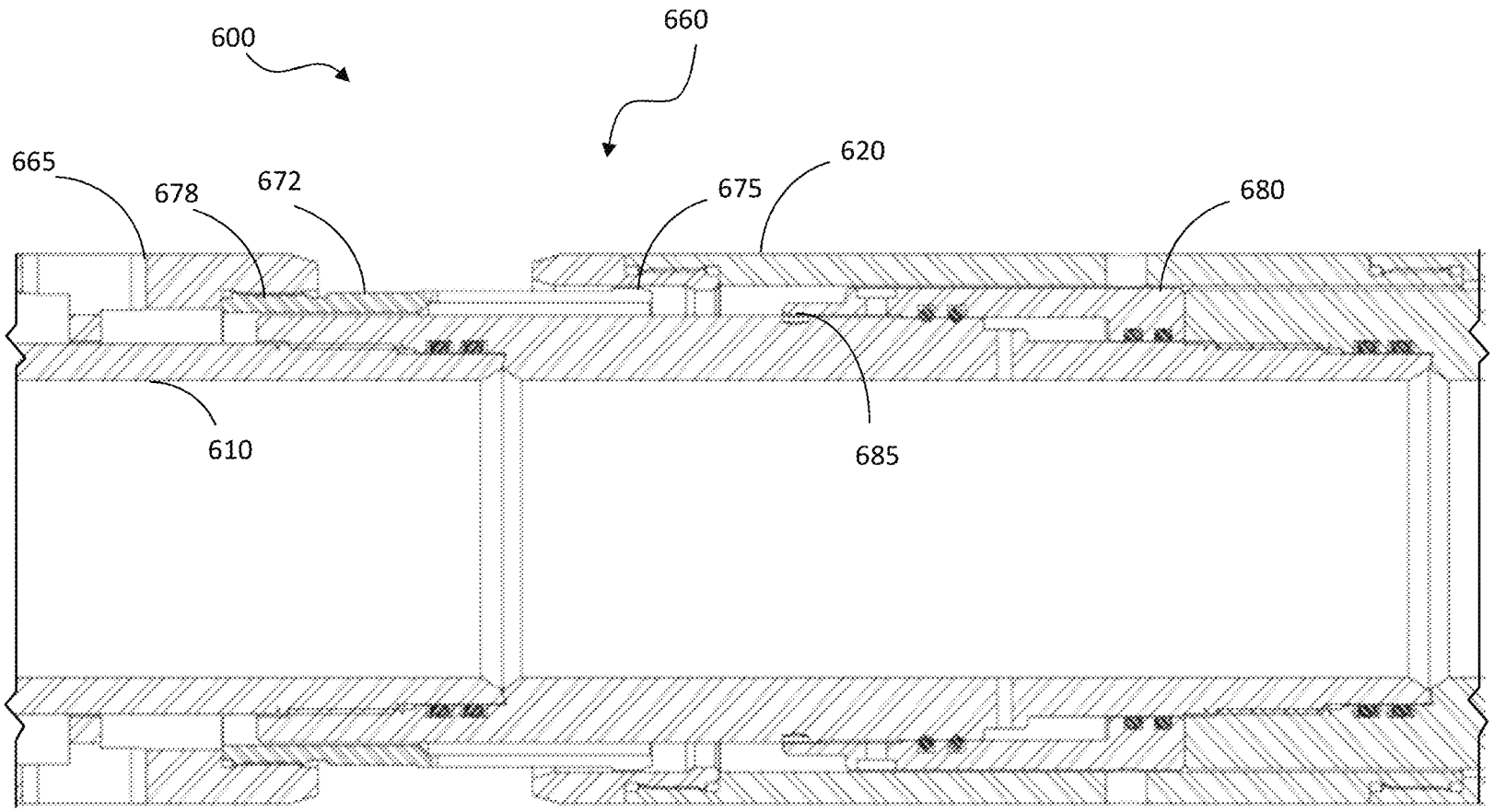

Referring now to FIGS. 8A-8C, there are shown views of the packer assembly 600 after the hydraulic setting assembly 660 has been activated, such that the packing element 605 may be set radially outward. As shown in FIG. 8B, the hydrostatic setting assembly 615 remains unchanged. FIG. 8C shows the hydraulic setting assembly 660 in a mechanically activated state. The piston locking mechanism 685 has been released and the hydraulic prop piston 680, in this embodiment, has stroked downhole, releasing the hydraulic locking mechanism 675 from engagement with the hydrostatic piston 620. The packing element activation sleeve 665 has been released and may then stroke uphole to engage the packing element 605 while the hydrostatic piston 620 remains in a relatively unchanged, un-activated position.

Aspects disclosed herein include:

A: A packer assembly, comprising: an inner mandrel; a packing element at least partially surrounding the inner mandrel; a packing element activation sleeve coupled to the packing element; a hydrostatic setting assembly engageable with the packing element activation sleeve, the hydrostatic setting assembly including: a hydrostatic piston; a hydrostatic prop piston engageable with the hydrostatic piston to push the hydrostatic piston to engage the packing element activation sleeve; and a hydrostatic locking mechanism, the hydrostatic locking mechanism engageable with the hydrostatic prop piston to maintain the hydrostatic piston in a hydrostatic locked position; and a hydraulic setting assembly positioned between the packing element and the hydrostatic setting assembly, the hydraulic setting assembly including: a hydraulic piston; a hydraulic locking mechanism coupled to the hydraulic piston; a hydraulic prop piston engageable with the hydraulic locking mechanism, the hydraulic prop piston operable to allow the hydraulic locking mechanism to move from a hydraulic locked position to a hydraulic unlocked position.

B: A well system, the well system comprising: a wellbore penetrating a subterranean formation; and a packer assembly, the packer assembly including: an inner mandrel; a packing element at least partially surrounding the inner mandrel; a packing element activation sleeve coupled to the packing element; a hydrostatic setting assembly engageable with the packing element activation sleeve, the hydrostatic setting assembly including: a hydrostatic piston; a hydrostatic prop piston engageable with the hydrostatic piston to push the hydrostatic piston to engage the packing element activation sleeve; and a hydrostatic locking mechanism, the hydrostatic locking mechanism engageable with the hydrostatic prop piston to maintain the hydrostatic piston in a hydrostatic locked position; and a hydraulic setting assembly positioned between the packing element and the hydrostatic setting assembly, the hydraulic setting assembly including: a hydraulic piston; a hydraulic locking mechanism coupled to the hydraulic piston; a hydraulic prop piston engageable with the hydraulic locking mechanism, the hydraulic prop piston operable to allow the hydraulic locking mechanism to move from a hydraulic locked position to a hydraulic unlocked position.

C: A method for setting a packing element into a wellbore, the method comprising: running a packer assembly into a wellbore, the packer assembly including: an inner mandrel; a packing element at least partially surrounding the inner mandrel; a packing element activation sleeve coupled to the packing element; a hydrostatic setting assembly engageable with the packing element activation sleeve, the hydrostatic setting assembly including: a hydrostatic piston; a hydrostatic prop piston engageable with the hydrostatic piston to push the hydrostatic piston to engage the packing element activation sleeve; and a hydrostatic locking mechanism, the hydrostatic locking mechanism engageable with the hydrostatic prop piston to maintain the hydrostatic piston in a hydrostatic locked position; and a hydraulic setting assembly positioned between the packing element and the hydrostatic setting assembly, the hydraulic setting assembly including: a hydraulic piston; a hydraulic locking mechanism coupled to the hydraulic piston; a hydraulic prop piston engageable with the hydraulic locking mechanism, the hydraulic prop piston operable to allow the hydraulic locking mechanism to move from a hydraulic locked position to a hydraulic unlocked position; determining that the hydrostatic setting assembly failed to engage the packing element activation sleeve; running a plug downhole into the packer assembly; and applying differential pressure from uphole to release the hydraulic locking mechanism and allow pressure to move the packing element activation sleeve uphole to engage the packing element.

Aspects A, B, and C may have one or more of the following additional elements in combination:

Element 1: wherein the hydrostatic setting assembly further includes a lock sleeve engageable with the hydrostatic locking mechanism and the hydrostatic piston;

Element 2: wherein the hydrostatic setting assembly further includes an inner locking mechanism positioned between the hydrostatic prop piston and the hydrostatic piston;

Element 3: wherein the inner locking mechanism is a collet;

Element 4: wherein the hydrostatic locking mechanism is a collet;

Element 5: wherein the hydrostatic setting assembly further includes a rupture disc;

Element 6: wherein the hydrostatic setting assembly further includes a shear feature coupleable with the hydrostatic piston and the hydrostatic locking mechanism;

Element 7: wherein the hydraulic prop piston includes a piston locking mechanism configured to extend within a recess in the inner mandrel and release the hydraulic locking mechanism;

Element 8: wherein the piston locking mechanism is a snap ring configured to snap within the recess in the inner mandrel and release the second locking mechanism; and Element 9: wherein the inner mandrel comprises at least two portions coupled together by a threaded connection.

Further additions, deletions, substitutions and modifications may be made to the described embodiments.

What is claimed is:

1. A packer assembly, comprising:
- an inner mandrel;
- a packing element at least partially surrounding the inner mandrel;
- a packing element activation sleeve coupled to the packing element;
- a hydrostatic setting assembly engageable with the packing element activation sleeve, the hydrostatic setting assembly including:
  - a hydrostatic piston;
  - a hydrostatic prop piston engageable with the hydrostatic piston to push the hydrostatic piston to engage the packing element activation sleeve; and
  - a hydrostatic locking mechanism, the hydrostatic locking mechanism engageable with the hydrostatic prop piston to maintain the hydrostatic piston in a hydrostatic locked position; and
- a hydraulic setting assembly positioned between the packing element and the hydrostatic setting assembly, the hydraulic setting assembly including:
  - a hydraulic piston;
  - a hydraulic locking mechanism coupled to the hydraulic piston;
  - a hydraulic prop piston engageable with the hydraulic locking mechanism, the hydraulic prop piston operable to allow the hydraulic locking mechanism to move from a hydraulic locked position to a hydraulic unlocked position.

2. The packing assembly according to claim 1, wherein the hydrostatic setting assembly further includes a lock sleeve engageable with the hydrostatic locking mechanism and the hydrostatic piston.

3. The packer assembly according to claim 2, wherein the hydrostatic setting assembly further includes an inner locking mechanism positioned between the hydrostatic prop piston and the hydrostatic piston.

4. The packer assembly according to claim 3, wherein the inner locking mechanism is a collet.

5. The packer assembly according to claim 1, wherein the hydrostatic locking mechanism is a collet.

6. The packer assembly according to claim 1 wherein the hydrostatic setting assembly further includes a rupture disc.

7. The packer assembly according to claim 6, wherein the hydrostatic setting assembly further includes a shear feature coupleable with the hydrostatic piston and the hydrostatic locking mechanism.

8. The packer assembly according to claim 1, wherein the hydraulic prop piston includes a piston locking mechanism configured to extend within a recess in the inner mandrel and release the hydraulic locking mechanism.

9. The packer assembly according to claim 8, wherein the piston locking mechanism is a snap ring configured to snap within the recess in the inner mandrel and release the second locking mechanism.

10. The packer assembly according to claim 1, wherein the inner mandrel comprises at least two portions coupled together by a threaded connection.

11. A well system, the well system comprising:
- a wellbore penetrating a subterranean formation; and
- a packer assembly, the packer assembly including:
  - an inner mandrel;
  - a packing element at least partially surrounding the inner mandrel;
  - a packing element activation sleeve coupled to the packing element;
  - a hydrostatic setting assembly engageable with the packing element activation sleeve, the hydrostatic setting assembly including:
    - a hydrostatic piston;
    - a hydrostatic prop piston engageable with the hydrostatic piston to push the hydrostatic piston to engage the packing element activation sleeve; and a hydrostatic locking mechanism, the hydrostatic locking mechanism engageable with the hydrostatic prop piston to maintain the hydrostatic piston in a hydrostatic locked position; and a hydraulic setting assembly positioned between the packing element and the hydrostatic setting assembly, the hydraulic setting assembly including:

a hydraulic piston;

a hydraulic locking mechanism coupled to the hydraulic piston;

a hydraulic prop piston engageable with the hydraulic locking mechanism, the hydraulic prop piston operable to allow the hydraulic locking mechanism to move from a hydraulic locked position to a hydraulic unlocked position.

12. The well system according to claim 11, wherein the hydrostatic setting assembly further includes a lock sleeve engageable with the hydrostatic locking mechanism and the hydrostatic piston.

13. The well system according to claim 12, wherein the hydrostatic setting assembly further includes an inner locking mechanism positioned between the hydrostatic prop piston and the hydrostatic piston.

14. The well system according to claim 13, wherein the inner locking mechanism is a collet.

15. The well system according to claim 11, wherein the hydrostatic locking mechanism is a collet.

16. The well system assembly according to claim 11 wherein the hydrostatic setting assembly further includes a rupture disc.

17. The well system according to claim 16, wherein the hydrostatic setting assembly further includes a shear feature coupleable with the hydrostatic piston and the hydrostatic locking mechanism.

18. The well system according to claim 11, wherein the hydraulic prop piston includes a piston locking mechanism configured to extend within a recess in the inner mandrel and release the hydraulic locking mechanism.

19. The well system according to claim 18, wherein the piston locking mechanism is a snap ring configured to snap within the recess in the inner mandrel and release the hydraulic locking mechanism.

20. A method for setting a packing element into a wellbore, the method comprising:

running a packer assembly into a wellbore, the packer assembly including:

an inner mandrel;

a packing element at least partially surrounding the inner mandrel;

a packing element activation sleeve coupled to the packing element;

a hydrostatic setting assembly engageable with the packing element activation sleeve, the hydrostatic setting assembly including:

a hydrostatic piston;

a hydrostatic prop piston engageable with the hydrostatic piston to push the hydrostatic piston to engage the packing element activation sleeve; and a hydrostatic locking mechanism, the hydrostatic locking mechanism engageable with the hydrostatic prop piston to maintain the hydrostatic piston in a hydrostatic locked position; and a hydraulic setting assembly positioned between the packing element and the hydrostatic setting assembly, the hydraulic setting assembly including:

a hydraulic piston;

a hydraulic locking mechanism coupled to the hydraulic piston;

a hydraulic prop piston engageable with the hydraulic locking mechanism, the hydraulic prop piston operable to allow the hydraulic locking mechanism to move from a hydraulic locked position to a hydraulic unlocked position;

determining that the hydrostatic setting assembly failed to engage the packing element activation sleeve;

running a plug downhole into the packer assembly; and applying differential pressure from uphole to release the hydraulic locking mechanism and allow pressure to move the packing element activation sleeve uphole to engage the packing element.

* * * * *